US005853625A

United States Patent [19]

Kensok et al.

[11] Patent Number: 5,853,625

[45] Date of Patent: Dec. 29, 1998

[54] WATER DISTRIBUTION TRAY FOR A PAD-TYPE HUMIDIFIER UNIT

[75] Inventors: Timothy J. Kensok, Minnetonka; Timothy J. Smith, Minneapolis, both of Minn.

[73] Assignee: Honeywell Inc., Minneapolis, Minn.

[21] Appl. No.: 883,986

[22] Filed: Jun. 27, 1997

[51] Int. Cl.[6] ..... B01F 3/04

[52] U.S. Cl. ..... 261/106; 261/DIG. 15; 239/289; 239/600

[58] Field of Search ..... 261/103, 106, 261/DIG. 15, DIG. 39, DIG. 41; 239/193, 194, 289, 600

[56] References Cited

U.S. PATENT DOCUMENTS

| | | | |
|---|---|---|---|
| 3,092,096 | 6/1963 | Nett et al. | 261/103 |
| 3,975,470 | 8/1976 | Engel | 261/106 |
| 4,125,576 | 11/1978 | Kozinski | 261/106 |
| 4,158,679 | 6/1979 | Yeagle | 261/106 |
| 4,338,264 | 7/1982 | Seeley | 261/106 |
| 4,351,781 | 9/1982 | Blatter | 261/106 |
| 4,460,520 | 7/1984 | Wrightson | 261/106 |
| 5,211,891 | 5/1993 | Anoszko | 261/106 |

OTHER PUBLICATIONS

Aprilaire Residential Humidifiers Parts List for Model 550/560, Apr. 1996.

*Primary Examiner*—C. Scott Bushey
*Attorney, Agent, or Firm*—Edward L. Schwarz

[57] ABSTRACT

An in-duct humidifier has an evaporative pad onto the top of which water is dripped. Air passing through the pad evaporates the water to thereby increase the air's humidity. An improved tray for dripping the water onto the top of the pad has a sloped floor in which are a number of holes. A nozzle assembly which is mounted directly on the top of the tray and an improved arrangement of walls on the tray floor assists in delivering equal amounts of water to all of the holes, resulting in even distribution of water throughout the pad and more efficient operation of the humidifier.

16 Claims, 4 Drawing Sheets

WATER DISTRIBUTION TRAY FOR A PAD-TYPE HUMIDIFIER UNIT

BACKGROUND OF THE INVENTION

In cold climates particularly where occupied spaces must be heated, air in these spaces tends to have low relative humidity. This is uncomfortable and sometimes even unhealthy. To remedy this problem, people use humidifiers to add humidity to the air in these spaces.

Humidifiers have a variety of different designs. There are small stand-alone units intended for a single room. Larger units are designed for permanent installation as a component of a central heating system. These add moisture to the stream of heated air passing through the furnace duct to the occupied space. The latter type of humidifier will be referred to as an "in-duct" humidifier hereafter. The humidifier whose description follows is an improvement to one common type of in-duct humidifier.

There are a number of different designs for in-duct humidifiers. The kind which is involved here has an air-permeable pad, typically made from a number of similarly sized layers of thin expanded aluminum sheet stacked to a thickness of perhaps 1.5 in. (3.8 cm.). The layers of aluminum sheet are bonded to each other so as to create a pad structure having a rectangular box-like shape. The pad is placed in or near the furnace duct so that air warmed by the furnace can flow through it. Water is allowed to drip onto the top surface of the pad at a rate which keeps the pad moist from top to bottom. The warm air passing through the pad evaporates water in the pad, adding humidity to the air.

The water drips onto the pad from what is called a water distribution tray, or simply a tray. The tray extends along the top surface of the pad and has a reservoir for holding a small amount of water. Water is fed to the tray from the building water supply, and flow is controlled by a solenoid valve. The tray has holes spaced along its bottom through which water flowing into the tray falls onto the top of the pad. By properly selecting the rate at which water is added to the tray, the pad can be kept moist from top to bottom. The pad, the tray, and a housing supporting them in the proper spatial relationship comprise the most important elements of an in-duct humidifier. It is important for efficient operation that the tray evenly distribute water across the entire width of the pad.

There are water distribution trays now known which have a number of holes distributed along the length of the tray and use individual ducts or channels each for conducting water to each hole. The idea apparently is that using individual channels to conduct water to the holes allows each hole to receive a full measure of the water, thereby assuring that the pad is evenly and fully soaked throughout. These designs do not always fully realize these goals and indeed may sometimes also cause further problems. For example, problems may arise that still prevent complete and uniform saturation of the pad. This may happen if the tray is not perfectly level, preventing an adequate amount of water to flow to all parts of the pad's top surface.

We have found that it is also important for all of the water in the tray to promptly drain onto the pad when water flow stops. This eliminates undrained pools of water which will continue to dry, depositing the minerals dissolved in this pooled water on the tray surfaces. Over time, these mineral deposits can build up to a level which interferes with the operation of the tray itself. The use of a number of individual channels to supply water to individual holes tends to exacerbate this problem.

BRIEF DESCRIPTION OF THE INVENTION

We have developed a water distribution tray which solves many of these problems. This water distribution tray has a generally elongate shape and is intended to be disposed in a level and upright position above the pad of a pad type humidifier. The tray comprises an elongate floor having first and second ends and having a plurality of holes distributed lengthwise in it. The tray further has a plurality of channels formed by vertical walls fixed to and projecting from the upper surface of the upright tray's floor. Each of said channels has an open end in flow communication with a water reception area of the floor and a second closed end forming a chamber enclosing at least one hole in the floor. The term "flow communication" means in this context, that water falling onto the water reception area will without restriction flow to each of the channels. We expect that roughly equal amounts of water will flow to each of the channels. The tray floor is shaped and positioned to slope downwardly from the water reception area when the tray is approximately level. The chamber of at least a first of the channels encloses a hole at a point within the first channel lower when the tray assembly is level, than any other point within the channel.

In the usual embodiment, each channel will direct convey water to a single hole. The usual embodiment will also have a centrally located water reception area from which the floor slopes downwardly toward each end of the floor.

There is also a nozzle assembly which attaches to the tray and directs water from a supply hose to the water reception area. The nozzle assembly and the tray preferably have attachment features which cooperate to fasten the nozzle assembly to the tray.

Transitions from horizontal surfaces to vertical surfaces are radiused to promote smooth and steady flow of water from the horizontal to the vertical surfaces.

DESCRIPTION OF THE PREFERRED EMBODIMENT

Figure 1:
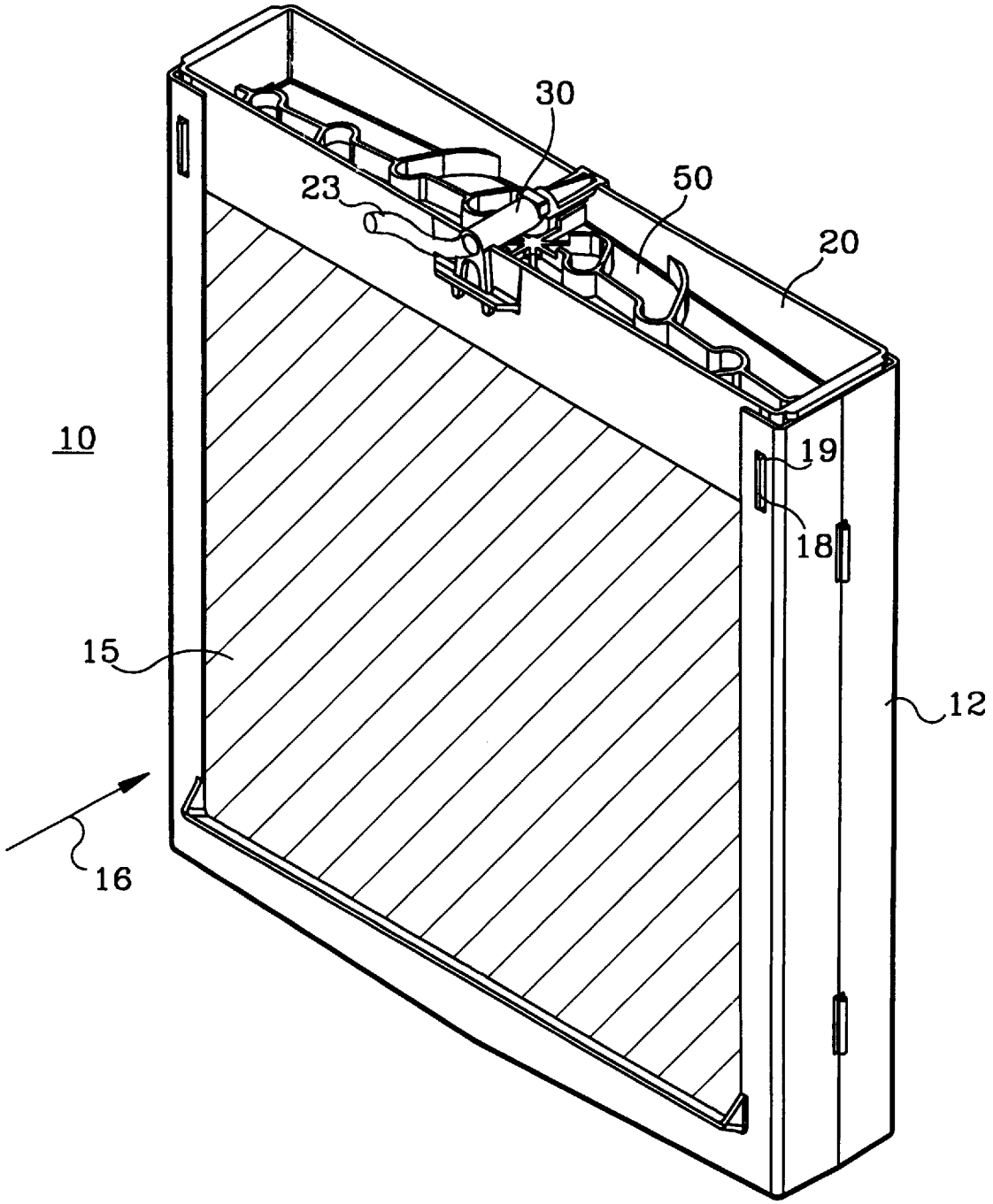
FIG. 1 is a perspective view of a evaporative pad assembly having the distribution tray of the invention as an element thereof.

FIG. 1 shows the tray 20 which embodies the inventive subject matter as forming an element of an evaporative pad subassembly 10 suitable for use in humidifier units such as are shown in U.S. Pat. Nos. 5,211,891; 4,158,679; and 3,975,470. We believe that it would be simple for a person of even modest skill to modify the housings of the humidifier units shown in these patents to accommodate the subassembly 10.

With further reference to FIG. 1, a U-shaped frame 12 encloses on three sides an evaporative pad 15 of the type described above. The distribution tray 20 incorporates the inventive subject matter disclosed by this patent. Frame 12 has sides having U-shaped cross sections into which tray 20 fits. Slot 19 and three similar slots in frame 12 receive tabs 18 and similar tabs projecting from the sides of tray 20 to retain tray 20 in the position shown. The sides of frame resiliently deflect outwardly to allow tab 18 and similar tabs to enter slot 19 and similar slots to firmly retain tray 20 as a part of subassembly 10 and to hold pad 15 within frame 12. Note that for proper operation the orientation of subassembly 10 shown with tray 20 upright and level is required. Pad 15 is permeable to both air and water, and may be made from a number of layers of expanded metal or from some other material having this permeability. Arrow 16 shows the general direction of air flow through pad 15.

Water is supplied to tray 20 by a nozzle assembly 30 mounted centrally above tray 20. Water is supplied to nozzle assembly 30 by a hose 23 or by some other water conduit.

Figure 2:
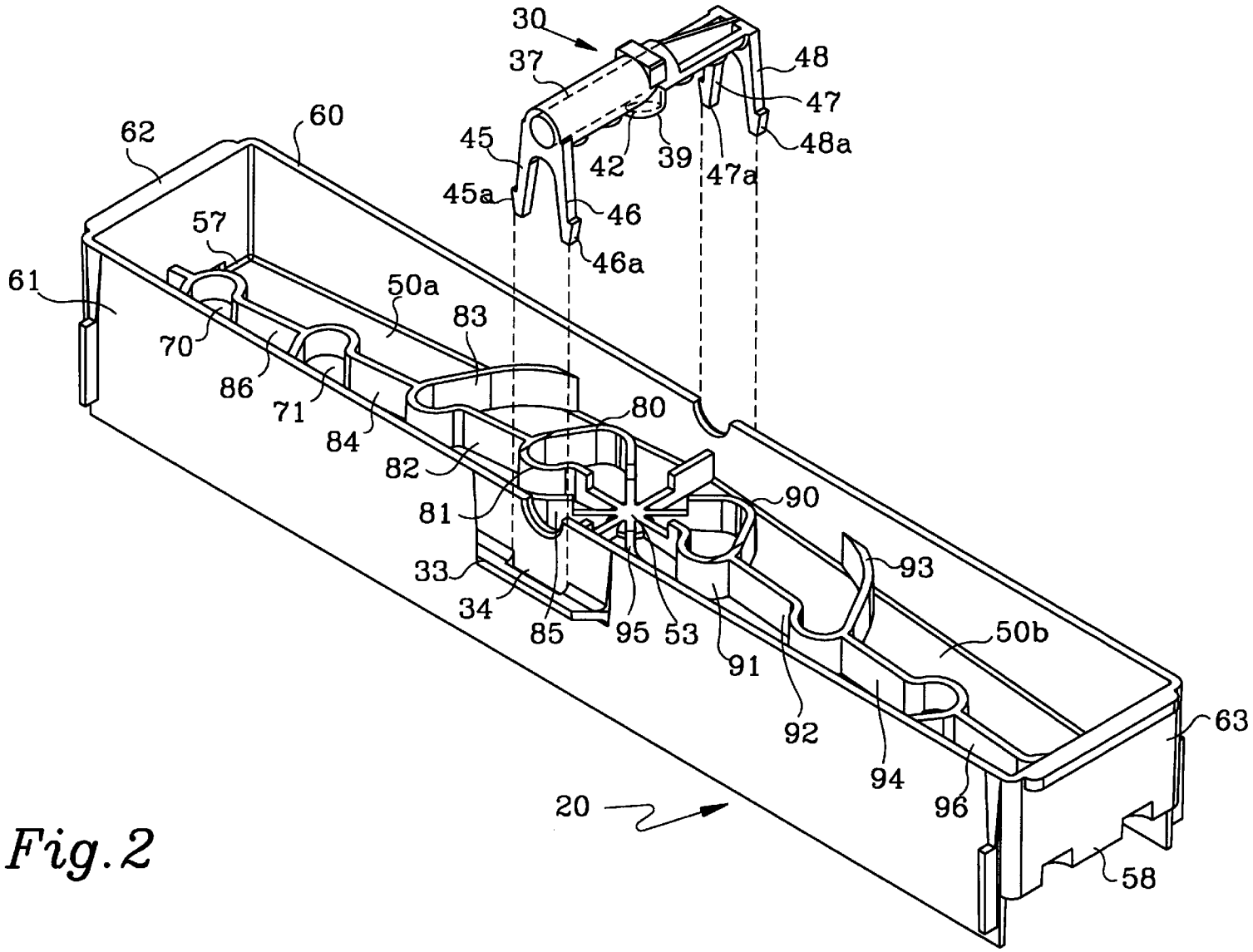
FIGS. 2 and 2*a* are perspective views of the distribution tray in exploded and assembled conditions.

The distribution tray 20 is shown in greater detail in FIG. 2, with nozzle assembly 30 in exploded relation thereto. Tray 20 includes an elongate floor, generally at 50, comprising floor segments 50*a* and 50*b* extending in opposite directions from a water reception area 53 directly below nozzle assembly 30. Water reception area 53 forms the top surface of a projection from floor 50. Floor segments 50*a* and 50*b* each slope downwardly from the water reception area 53 to their respective ends 57 and 58 when tray 20 is in its level operating position as shown in FIG. 2. It is easy to see in the side section view of FIG. 4 how floor segments 50*a* and 50*b* slope downwardly at a shallow angle. Tray 20 has side walls 60 and 61 and end walls 62 and 63 which cooperate to define an interior space of tray 20.

Floor segments 50*a* and 50*b* have holes 70–73 and 74–77 respectively distributed lengthwise in them. These holes are directly above the upper surface of pad 15 as shown in FIG. 1, so that water dripping or flowing through the holes will fall onto pad 15 and suffuse the entire pad with water so that air flowing through pad 15 will evaporate most of this water thereby increasing the air's humidity. One preferred diameter for each of the holes 70–77 is 0.37 in. (0.94 cm.). The slope of floor segments 50*a* and 50*b* more uniformly distributes water to the individual holes 70–77 and across the breadth of pad 15.

Figure 4:
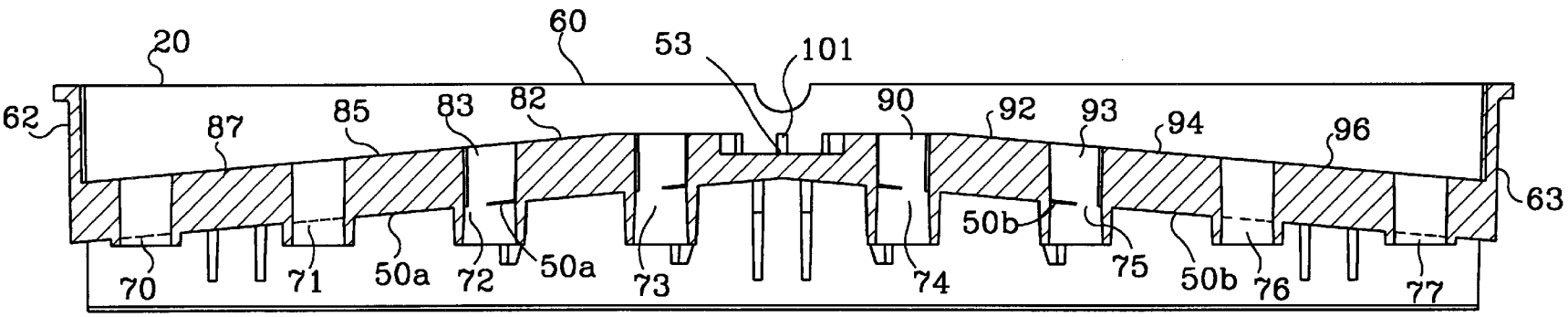
FIG. 4 is a side section view of the distribution tray.

In order to further promote even distribution of water across the entire breadth of pad 15, holes 70–73 and 74–77 receive water from individual channels or ducts formed by walls projecting from and fixed to the upper surface of floor segments 50*a* and 50*b*. In the embodiment shown in the Figs. there are eight channels, each channel supplying water for one only of the holes 70–77. Each channel is defined by two or more individual walls or wall segments. The water reception area 53 opens to and is in flow communication with a first end of each channel. Openings from water reception area 53 to each channel are almost exactly identical in all respects so as to cause nearly equal amounts of water to flow into each channel during use. Each channel also has a second end which is closed and surrounds a single one of the holes 70–77. Bearing in mind the slope of floor segments 50*a* and 50*b* away from the water reception area 53, we configure the holes 70–77 positions relative to the individual wall segments to assure that each hole is located at the lowest point within its individual channel. FIG. 4 illustrates this configuration as a brief review of it reveals.

For convenience, the wall segments forming the channels are identified by a number of different reference numbers. Each individual wall segment is specified by two identical reference numbers whose lead lines indicate the two ends of the particular wall segment. For example, the lead lines for the two reference numbers for wall segment 81 define it as having a curved portion surrounding approximately one half of hole 73 and having a linear portion further extending part of the way from hole 73 to water reception area 53. There is a substantially lower transition wall section extending from wall segment 81 to the water reception area 53. This lower wall section and similar lower wall sections are intended to assist in diverting approximately equal amounts of the water impinging on area 53 into each channel.

Each channel can be defined by two or more of these wall segments. For example, the channel supplying water to hole 70 is defined by wall segments 100, 61, 87, 86, and 85, starting at water reception area 53 and proceeding clockwise around the entire channel periphery from one wall or wall segment to another to the associated hole, and then continuing back to area 53. The following table summarizes the individual wall segments which form the individual channels for each hole 70–77 in terms of the individual wall segments' reference number assignments. Each sequence in the table defines a channel by its associated hole, and starts with the wall segment closest to water reception area 53 for clockwise definition of the channel periphery.

| Hole | Wall Segments | | | | |
|---|---|---|---|---|---|
| 70 | 100 | 61 | 87 | 86 | 85 |
| 71 | 85 | 84 | 82 | 81 | |
| 72 | 80 | 82 | 83 | 60 | 101 |
| 73 | 81 | 80 | | | |
| 74 | 90 | 91 | | | |
| 75 | 101 | 60 | 93 | 92 | 90 |
| 76 | 91 | 92 | 94 | 95 | |
| 77 | 95 | 96 | 97 | 61 | 100 |

Figure 3:
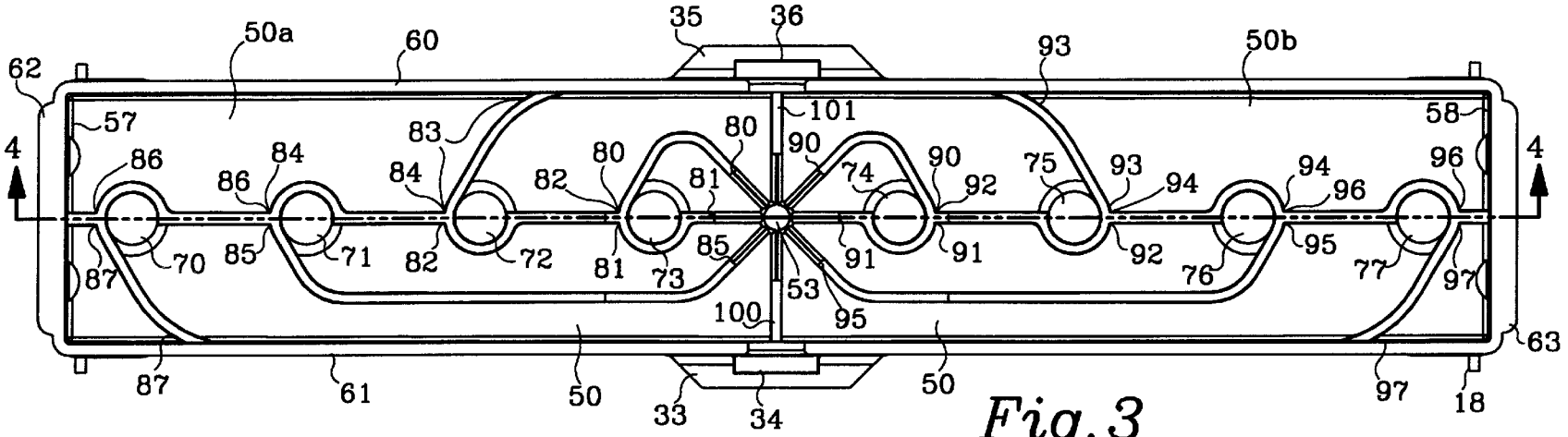
FIG. 3 is a top projective view of the distribution tray.

In each of these channels, one can see from FIG. 3 that the hole in floor 50 is located at the closed end of the channel and from FIG. 4 that the location of the hole is at the lowest point of elevation in the channel. This assures that all water in each channel will drain to the hole therein when flow of water to the nozzle assembly 30 stops. Thus little or no water will be left standing in the individual channels, and the opportunity for buildup of dissolved minerals is minimized.

Figure 2A:
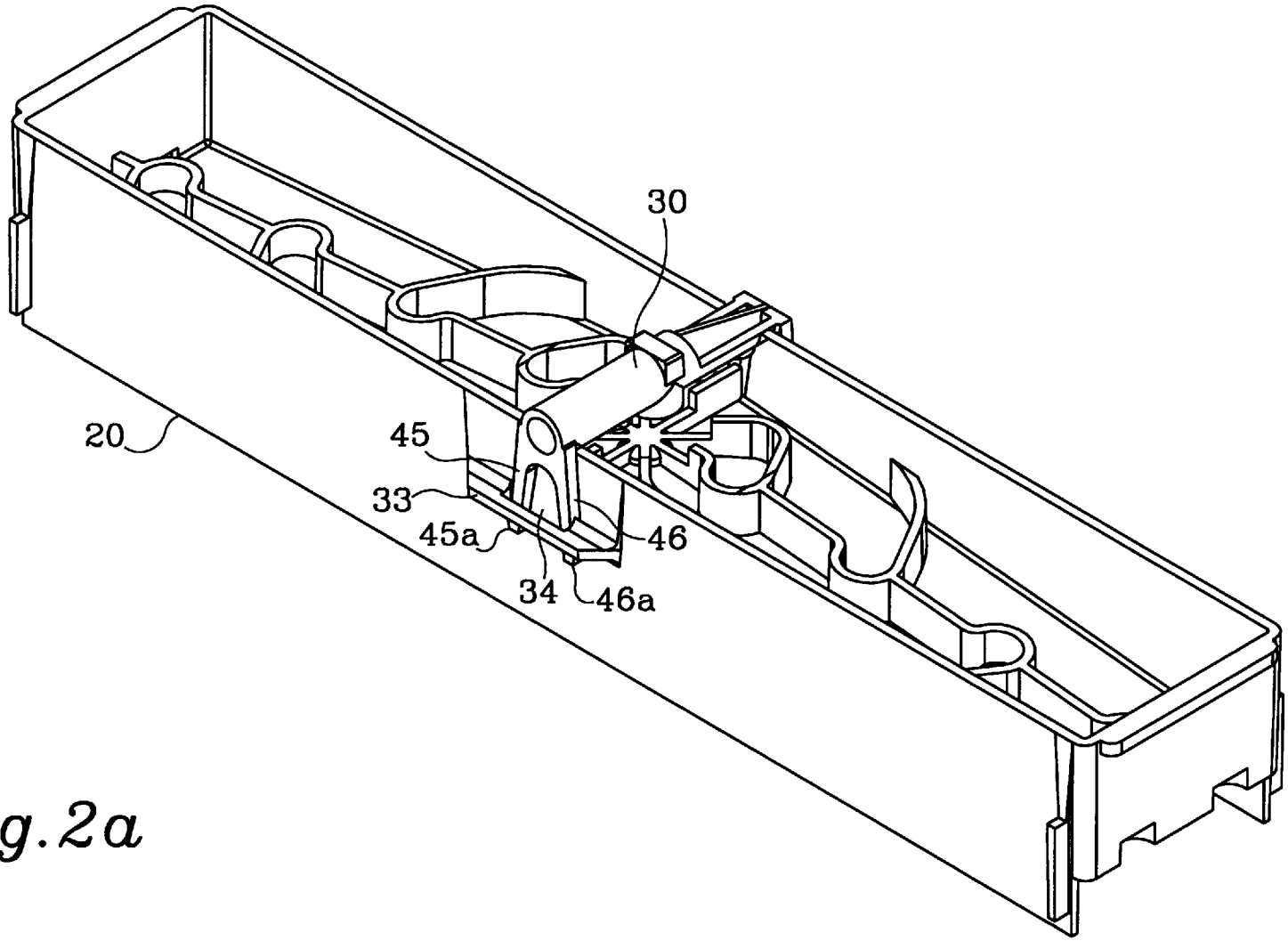

Nozzle assembly 30 is intended to latch into a predetermined position above the water reception area 53 so as to directly supply water to the individual holes 70–77. In FIG. 2, an internal water duct 37 shown in dotted outline runs half way through the length of nozzle assembly 30 to connect with an orifice 42 (also shown in dotted outline) within a projection 39. One preferred diameter for orifice 42 is 0.125 in. (0.32 cm.). Assembly 30 is supported and retained in its operating position as shown in FIG. 2*a* by a first attachment feature forming a part of tray 20 and which cooperates with a second attachment feature forming a part of nozzle assembly 30. There are any number of ways to configure these attachment features. One suitable configuration is shown in FIGS. 2 and 2*a*, and in fact forms the present commercial embodiment.

The first attachment feature comprises brackets 33 and 35 fixed to walls 61 and 60 respectively and which define between themselves and the adjacent walls, slots 34 and 36 (FIG. 3). Nozzle assembly 30 has at opposite ends a pair of resilient arms 45, 46 and 47, 48, each of which has at the end thereof a detent feature 45*a*, 46*a*, 47*a*, 48*a* in the form of a bulge or step. Each pair of arms 45, 46 and 47, 48 have the general shape of a wishbone with the detent feature thereon facing away from the other arm of the pair. The dimensions of the tray, nozzle assembly, and first and second attachment features are all chosen to allow each arm 45–48 to enter one of the slots 34 and 36 while attaching nozzle assembly 30 to tray 20. During this operation, each arm of each pair of arms 45, 46, and 47, 48 will be deflected toward the other arm of the pair. The resilience of the individual arms 45–48 causes the detent features 45*a*–48*a* to latch with the ends of the slots 34, 36 to firmly mount the nozzle assembly in the desired position on tray 20. By deflecting the arms 45–48 it is easy to detach nozzle assembly from tray 20.

In operation, a metered amount of water is allowed to flow through the hose 23 shown in FIG. 1 while warm air is blown through pad 15 in the direction of arrow 16 (FIG. 1). This air causes water in pad 15 to evaporate and be taken up by the air stream, raising its humidity. Of course, there should not be so much water allowed to flow into nozzle assembly 30 that water will overflow any of the wall segments. Given that the individual holes 70–77 are typically slightly larger than the orifice 42 itself, it's unlikely that such an event will occur. Furthermore, water flow to nozzle assembly 30 is typically metered in a way which provides for saturating pad 15 and allowing some flow of excess water from the bottom of pad 15, but there is no need to apply so much water to pad 15 that large amounts of eventually unevaporated water flow through it.

For a pad 15 having large dimensions of 9.5×9.8 in. (24.1×24.9 cm.) and air flow velocity of 20 ft./sec. (6.1 meters/sec.), total water evaporated may be about 12 gal./day (45 liters/day), and the total amount of water supplied to assembly 30 may be approximately five times the amount of water actually evaporated from pad 15. By supplying an excess of water to pad 15, minerals which might otherwise deposit themselves on tray 20 and pad 15 are to some extent flushed out of the system.

We have a number of features in this embodiment which we find make significant contributions to the even distribution of water to the individual holes 70–77. A first of these are the aspects of our design which accurately delivers water near the center of water reception area 53. The arrangement we have of attaching the nozzle assembly 30 directly to the tray 20 assures that orifice 42 is securely and centrally positioned with respect to water reception area 53. It is also very preferable to have the diameter of orifice 42 substantially smaller than the diameter of water reception area 53. In our design water reception area 53 has a diameter of 0.225 in. (0.57 cm.). Even such a relatively small diameter as 0.125 in. for orifice 42 does not result in high speed flow velocity for the exiting water at a flow rate of less than say, 3.5 gal./hour. By selecting the diameter of orifice 42 to be substantially smaller than that of area 53, water will usually impact area 53 quite close to its center and then distribute itself relatively evenly to each of the channels.

Secondly, transitions from horizontal to vertical surfaces over which the water flows should be radiused so that flow from each of these surfaces to the next will be smooth and consistent. In particular, the top edges or surfaces of the lower wall sections forming the transitions from individual wall segments 80, 81, etc. to water reception area 53 should be radiused and blend smoothly into the side walls of these lower wall sections. We find that radiuses on these surfaces promote relatively equal diversion of the water flowing onto water reception area 53, to the individual channels. The transition between water reception area 53 and the walls of the projection which carries it should also be radiused. A suitable radius of curvature for each of these lower wall sections can be in the range of 0.03 in. (0.075 cm.). Lastly, radiusing the transitions from floor 50 to the walls of the individual holes 70–77 allows water to flow smoothly from floor 50 within the individual channels into the holes 70–77. A suitable radius of curvature for these floor to hole wall transitions can be in the range of 0.06 to 0.1 in. (0.15 to 0.25 cm.). Referring to FIG. 3, one can see these curved transitions indicated along the wall transition areas to water reception area 53, around the water reception area 53 between the lower transition wall segments, and finally, surrounding the individual holes 70–77. The improvement in water flow across these transition areas which these radiused surfaces lend is substantial.

The structure of the wall segments and the holes 70–77, the slope in floor 50, the precise registration of the orifice 42 above the water reception area 53, and the size differential between orifice 42 and area 53 results in nearly equal amounts of water delivered to each hole 70–77. Equal amounts of water delivered to each hole results in more uniform saturation of pad 15. Uniform saturation of pad 15 allows a humidifier of a given size to more efficiently increase the humidity of the air passing through it. Where a duct is small or the space for a humidifier is limited, such improved efficiency may even result in a quantitative increase in humidity level which is not possible with more conventional humidifiers.

A person skilled in this technology will find many possible variations on the particular embodiment disclosed. For example, the number of holes may be increased or decreased and the shape and arrangement of the wall segments can be changed. The floor segments 50*a* and 50*b* need not be perfectly flat. All of these variations and any others as well within the spirit of this invention as described above, except of course for any variations already a part of the prior art, are intended to be a part of our invention and are included in the claims which follow.

We claim:

1. An elongate water distribution tray to be disposed in a level, upright position above a pad in a pad type humidifier, said tray comprising an elongate floor having first and second ends and having a plurality of holes distributed lengthwise in it, said tray further having a plurality of channels formed by vertical walls projecting from the upper surface of the upright tray's floor, each said channel having an open end in flow communication with a water reception area of the floor and a second closed end forming a chamber enclosing at least one hole in the floor, wherein when the tray is level, the tray floor slopes downwardly from the water reception area, and wherein the chamber of at least a first of the channels encloses a hole at a point within the first channel lower when the tray assembly is level, than any other point within the channel.

2. The tray of claim 1 wherein the tray floor slopes uniformly down from the water reception area in the direction of the first floor end, and wherein at least one hole within the first channel is located at the point of the channel furthest from the water reception area.

3. The tray of claim 2 wherein a hole within each of the channels is located at the point of the channel furthest from the water reception area.

4. The tray of claim 3, wherein the water reception area is approximately equi-spaced between the first and second floor ends, and wherein when the tray is level, the floor slopes downwardly from the water reception area toward each of the first and second floor ends.

5. The tray of claim 4 further including a first attachment feature and further comprising in combination, a water supply nozzle assembly having a duct for attaching to a source of pressurized water and in flow connection with a nozzle opening, said nozzle assembly having a second attachment feature cooperatively mating with the first attachment feature to retain the nozzle assembly on the tray with the nozzle opening in opposed relation to the water reception area.

6. The tray of claim 5, wherein the first attachment feature comprises a bracket attached to the tray, said bracket having a slot therein and wherein the second attachment feature comprises a pair of projecting resilient arms whose dimensions allow their entry into the bracket's slot when the resilient arms are deflected in a predetermined manner.

7. The tray of claim 6, wherein the undeflected arms together form the general shape of a wishbone.

8. The tray of claim 7, wherein the arms include detent features thereon.

9. The tray of claim 5, wherein the nozzle opening of the nozzle assembly is positioned centrally above the water reception area.

10. The tray of claim 9, wherein the nozzle opening is substantially smaller than the water reception area.

11. The tray of claim 5, wherein the nozzle opening is substantially smaller than the water reception area.

12. The tray of claim 1 wherein each of the channels encloses a hole at a point within the chamber thereof lower when the tray assembly is level, than any other point within the channel, and wherein the tray floor slopes uniformly down from the water reception area in the direction of the first floor end, and wherein at least one hole within the first channel is located at the point of the channel furthest from the water reception area.

13. The tray of claim 9 wherein a hole within each of the channels is located at the point of the channel furthest from the water reception area.

14. The tray of claim 10, wherein the water reception area is approximately equi-spaced between the first and second floor ends, and wherein when the tray is level, the floor slopes downwardly from the water reception area toward each of the first and second floor ends.

15. The tray of claim 1, wherein the hole has a wall, and wherein the transition between the floor and the hole's wall is a radius of curvature.

16. The tray of claim 1, wherein at least one wall defining a channel has a lower wall section forming a transition to the water reception area, said lower wall section having at its top surface a radius of curvature.

* * * * *